US007950772B2

(12) United States Patent
Silverbrook

(10) Patent No.: US 7,950,772 B2
(45) Date of Patent: May 31, 2011

(54) PRINTHEAD ASSEMBLY HAVING SUPPORTING STRUCTURE OF ALTERNATING MATERIALS

(75) Inventor: Kia Silverbrook, Balmain (AU)

(73) Assignee: Silverbrook Research Pty Ltd., Balmain, New South Wales (AU)

( * ) Notice: Subject to any disclaimer, the term of this patent is extended or adjusted under 35 U.S.C. 154(b) by 0 days.

(21) Appl. No.: 12/536,373

(22) Filed: Aug. 5, 2009

(65) Prior Publication Data

US 2009/0295860 A1 Dec. 3, 2009

Related U.S. Application Data

(63) Continuation of application No. 11/834,635, filed on Aug. 6, 2007, now Pat. No. 7,581,815, which is a continuation of application No. 11/048,822, filed on Feb. 3, 2005, now Pat. No. 7,270,396, which is a continuation of application No. 10/713,076, filed on Nov. 17, 2003, now Pat. No. 6,869,167, which is a continuation of application No. 10/129,434, filed as application No. PCT/AU01/00238 on Mar. 6, 2001, now Pat. No. 6,659,590.

(30) Foreign Application Priority Data

Mar. 6, 2000 (AU) ..... PQ6059

(51) Int. Cl.
*B41J 2/155* (2006.01)
*B41J 2/14* (2006.01)

(52) U.S. Cl. ..... 347/42; 347/49

(58) Field of Classification Search ..... 347/42, 347/49

See application file for complete search history.

(56) References Cited

U.S. PATENT DOCUMENTS

| | | | |
|---|---|---|---|
| 4,777,583 | A | 10/1988 | Minami et al. |
| 4,829,321 | A | 5/1989 | Iizuka et al. |
| 5,528,272 | A | 6/1996 | Quinn et al. |
| 6,250,738 | B1 | 6/2001 | Waller et al. |
| 6,322,206 | B1 | 11/2001 | Boyd et al. |
| 6,428,145 | B1 | 8/2002 | Feinn et al. |
| 6,984,022 | B2 | 1/2006 | Silverbrook |

FOREIGN PATENT DOCUMENTS

| | | | |
|---|---|---|---|
| EP | 0566116 | A | 10/1993 |
| EP | 0646466 | A | 4/1995 |
| EP | 1043158 | A2 | 10/2000 |
| JP | 10128974 | A | 5/1998 |
| JP | 10181015 | A | 7/1998 |
| WO | WO 99/65609 | A | 12/1999 |

*Primary Examiner* — Julian D Huffman

(57) ABSTRACT

A printhead assembly includes a support beam formed of two types of material having different coefficients of thermal expansion, the two materials being repeatedly alternated in segments over the length of the support beam to form the support beam; and a plurality of spaced apart printhead modules supported by the support beam. A first one of the materials has a coefficient of thermal expansion greater than that of silicon, and a second one of the materials has a coefficient of thermal expansion less than that of silicon.

2 Claims, 2 Drawing Sheets

PRINTHEAD ASSEMBLY HAVING SUPPORTING STRUCTURE OF ALTERNATING MATERIALS

CROSS REFERENCE TO RELATED APPLICATION

The present application is a Continuation of U.S. application Ser. No. 11/834,635 filed on Aug. 6, 2007, now issued U.S. Pat. No. 7,581,815, which is a Continuation of U.S. application Ser. No. 11/048,822 filed on Feb. 3, 2005, now issued U.S. Pat. No. 7,270,396, which is a Continuation of U.S. application Ser. No. 10/713,076 filed on Nov. 17, 2003, now issued U.S. Pat. No. 6,869,167, which is a Continuation of U.S. application Ser. No. 10/129,434 filed on May 6, 2002, now issued U.S. Pat. No. 6,659,590, which is a 371 of PCT/AU01/00238 filed on Mar. 6, 2001, the entire contents of which are herein incorporated by reference.

FIELD OF THE INVENTION

The present invention relates to modular printheads for digital printers and in particular to pagewidth inkjet printers.

CO-PENDING APPLICATIONS

Various methods, systems and apparatus relating to the present invention are disclosed in the following co-pending applications filed by the applicant or assignee of the present invention on 24 May 2000:

| | | | |
|---|---|---|---|
| PCT/AU00/00578 | PCT/AU00/00579 | PCT/AU00/00581 | PCT/AU00/00580 |
| PCT/AU00/00582 | PCT/AU00/00587 | PCT/AU00/00588 | PCT/AU00/00589 |
| PCT/AU00/00583 | PCT/AU00/00593 | PCT/AU00/00590 | PCT/AU00/00591 |
| PCT/AU00/00592 | PCT/AU00/00584 | PCT/AU00/00585 | PCT/AU00/00586 |
| PCT/AU00/00594 | PCT/AU00/00595 | PCT/AU00/00596 | PCT/AU00/00597 |
| PCT/AU00/00598 | PCT/AU00/00516 | PCT/AU00/00517 | PCT/AU00/00511 |

Various methods, systems and apparatus relating to the present invention are disclosed in the following co-pending application, PCT/AU00/01445 filed by the applicant or assignee of the present invention on 27 Nov. 2000. The disclosures of these co-pending applications are incorporated herein by cross-reference. Also incorporated by cross-reference, is the disclosure of a co-filed PCT application, PCT/AU01/00239 (deriving priority from Australian Provisional Patent Application No. PQ6058).

BACKGROUND OF THE INVENTION

Recently, inkjet printers have been developed which use printheads manufactured by micro electro mechanical systems (MEMS) techniques. Such printheads have arrays of microscopic ink ejector nozzles formed in a silicon chip using MEMS manufacturing techniques.

Printheads of this type are well suited for use in pagewidth printers. Pagewidth printers have stationary printheads that extend the width of the page to increase printing speeds. Pagewidth printers are able to print more quickly than conventional printers because the printhead does not traverse back and forth across the page.

To reduce production and operating costs, the printheads are made up of separate printhead modules mounted adjacent each other on a support beam in the printer. To ensure that there are no gaps or overlaps in the printing, it is necessary to accurately align the modules after they have been mounted to the support beam. Once aligned, the printing from each module precisely abuts the printing from adjacent modules.

Unfortunately, the alignment of the printhead modules at ambient temperature will change when the support beam expands as it heats up to the operating temperature of the printer. Furthermore, if the printhead modules are accurately aligned when the support beam is at the equilibrium operating temperature of the printer, then unacceptable misalignments in the printing may occur before the beam reaches the operating temperature. Even if the printhead is not modularized thereby making the alignment problem irrelevant, the support beam and printhead may bow and distort the printing because of the different thermal expansion characteristics.

SUMMARY OF THE INVENTION

According to one aspect of the present disclosure, a printhead assembly includes a support beam formed of two types of material having different coefficients of thermal expansion, the two materials being repeatedly alternated in segments over the length of the support beam to form the support beam; and a plurality of spaced apart printhead modules supported by the support beam. A first one of the materials has a coefficient of thermal expansion greater than that of silicon, and a second one of the materials has a coefficient of thermal expansion less than that of silicon.

BRIEF DESCRIPTION OF THE DRAWING

A preferred embodiment of the invention will now be described, by way of example only, with reference to the accompanying drawing in which.

DETAILED DESCRIPTION OF THE PREFERRED EMBODIMENT

Figure 1:
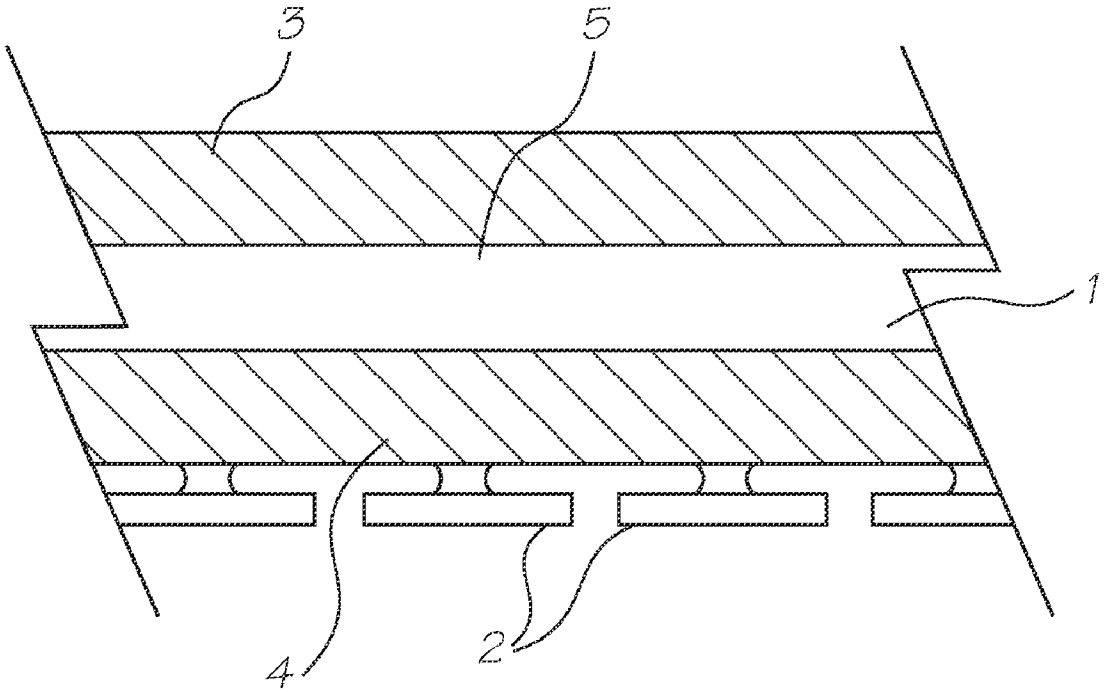
FIG. 1 is a schematic longitudinal cross section of a first embodiment of a printhead assembly according to the present invention; and, FIG. 2 is a schematic longitudinal cross section of a second embodiment of a printhead assembly according to the present invention.

Referring to FIG. 1, the printhead assembly has a support beam 1 supporting a plurality of printhead modules 2 each having a silicon MEMS printhead chip. The support beam 1 is a hot rolled three-layer laminate consisting of two different materials. The outer layers 3 and 4 are formed from invar which typically has a coefficient of thermal expansion of about $1.3\times10^{-6}$ metres per degree Celsius. The coefficient of thermal expansion of silicon is about $2.5\times10^{-6}$ metres per degree Celsius and therefore the central layer 5 must have a coefficient of thermal expansion greater than this in order to give the support beam as a whole a coefficient of thermal expansion substantially equal to that of silicon.

It will be appreciated that the effective coefficient of thermal expansion of the support beam will depend on the coefficient of thermal expansion of both metals, the Young's Modulus of both metals and the thickness of each layer. In order to prevent the beam from bowing, the outer layers 3 and 4 should be the same thickness.

Figure 2:
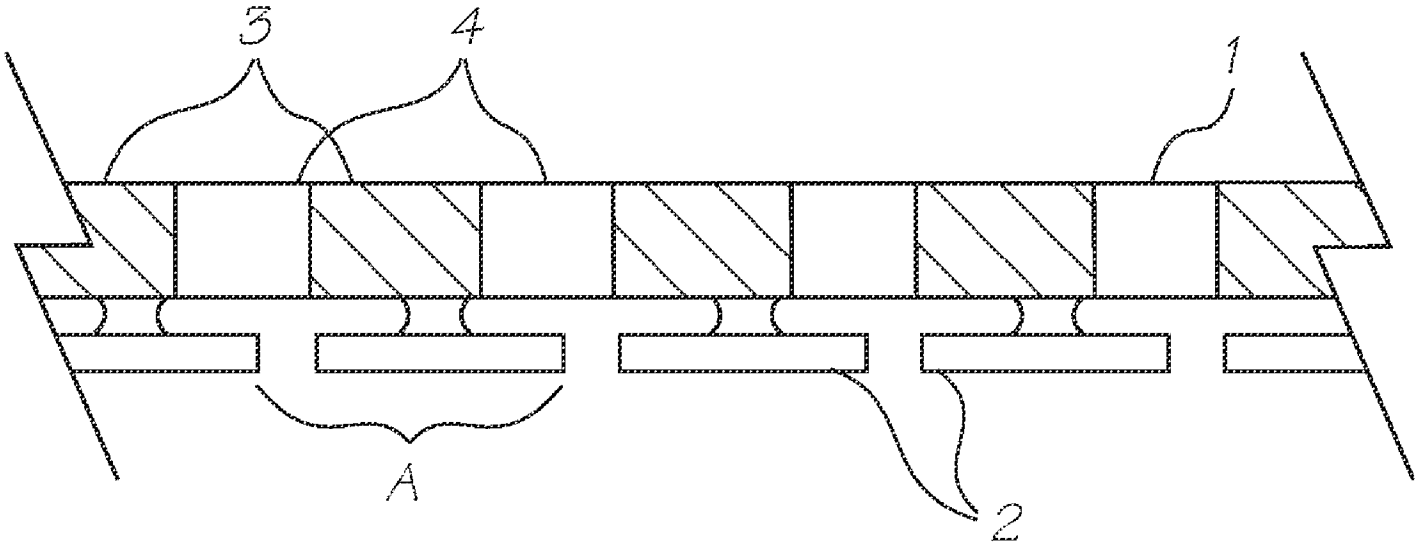

Referring to FIG. 2, the printhead assembly shown as an elongate support beam 1 supporting the printhead modules 2. Each printhead module has a silicon MEMS printhead chip.

The support beam 1 is formed from two different materials 3 and 4 bonded together end to end. Again, one of the materials has a coefficient of thermal expansion less than that of silicon and the other material has one greater than that of silicon. The length of each segment is selected such that the printhead spacing, or printhead pitch A, has an effective coefficient of thermal expansion substantially equal to that of silicon.

It will be appreciated that the present invention has been described herein by way of example only. Skilled workers in this field would recognize many other embodiments and variations which do not depart from the scope of the invention.

We claim:

1. A printhead assembly comprising:

a support beam formed of two types of material having different coefficients of thermal expansion, the two materials being repeatedly alternated in segments over the length of the support beam to form the support beam; and a plurality of spaced apart printhead modules supported by the support beam, wherein a first one of the materials is invar and has a coefficient of thermal expansion greater than that of silicon, and a second one of the materials has a coefficient of thermal expansion less than that of silicon.

2. A printhead assembly as claimed in claim 1, wherein apart from at ends of the support beam, each segment of one type of material is interposed between adjacent segments of the other type of material.

* * * * *